US010747139B1

(12) United States Patent
Ueno

(10) Patent No.: US 10,747,139 B1
(45) Date of Patent: Aug. 18, 2020

(54) CONTROL CIRCUIT, IMAGE FORMING APPARATUS, AND CONTROL METHOD

(71) Applicant: TOSHIBA TEC KABUSHIKI KAISHA, Tokyo (JP)

(72) Inventor: Sueo Ueno, Mishima Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/566,577

(22) Filed: Sep. 10, 2019

(51) Int. Cl.
*G03G 15/043* (2006.01)

(52) U.S. Cl.
CPC ..... *G03G 15/043* (2013.01)

(58) Field of Classification Search
CPC . G03G 15/04; G03G 15/043; G03G 15/04054
See application file for complete search history.

(56) References Cited

U.S. PATENT DOCUMENTS 5,519,431 A 5/1996 Kusano et al.
2006/0093387 A1* 5/2006 Hori ..... G03G 15/043 399/51
2013/0147891 A1* 6/2013 Koga ..... G03G 15/043 347/118
2015/0365554 A1* 12/2015 Kawana ..... H04N 1/1135 358/474
2017/0180583 A1 6/2017 Ueno

* cited by examiner

*Primary Examiner* — Gregory H Curran
(74) *Attorney, Agent, or Firm* — Kim & Stewart LLP

(57) ABSTRACT

A control circuit for an image forming apparatus includes a plurality of beam sources each configured to emit a beam, a photodetector configured to detect an intensity of the beam emitted from the plurality of beam sources, a processor configured to measure a slope efficiency of each beam source by controlling each beam source to emit the beam with different drive currents, and acquiring the intensity of each beam detected by the photodetector, and while a job is performed by the image forming apparatus, detect a current flowing in each beam source, determine an adjustment amount of a drive current for each beam source so that the beam source emits the beam at a predetermined output, based on the detected current and the measured slope efficiency, and adjust the drive current with the determined adjustment amount.

20 Claims, 11 Drawing Sheets

CONTROL CIRCUIT, IMAGE FORMING APPARATUS, AND CONTROL METHOD

FIELD

Embodiments described herein relate generally to a control circuit, an image forming apparatus, and a control method therefor.

BACKGROUND

There is an optical scanning apparatus using a multi-beam light source, such as two beams, four beams, and eight beams. The multi-beam light source incorporates, for example, a plurality of laser diodes for emitting beams and one photodiode for detecting light emitted from the laser diodes. In such an optical scanning apparatus, automatic power control (APC) is performed one by one for the plurality of laser diodes. Therefore, the optical scanning apparatus takes longer time for APC as the number of laser diodes provided in the light source increases.

DETAILED DESCRIPTION

Figure 1:
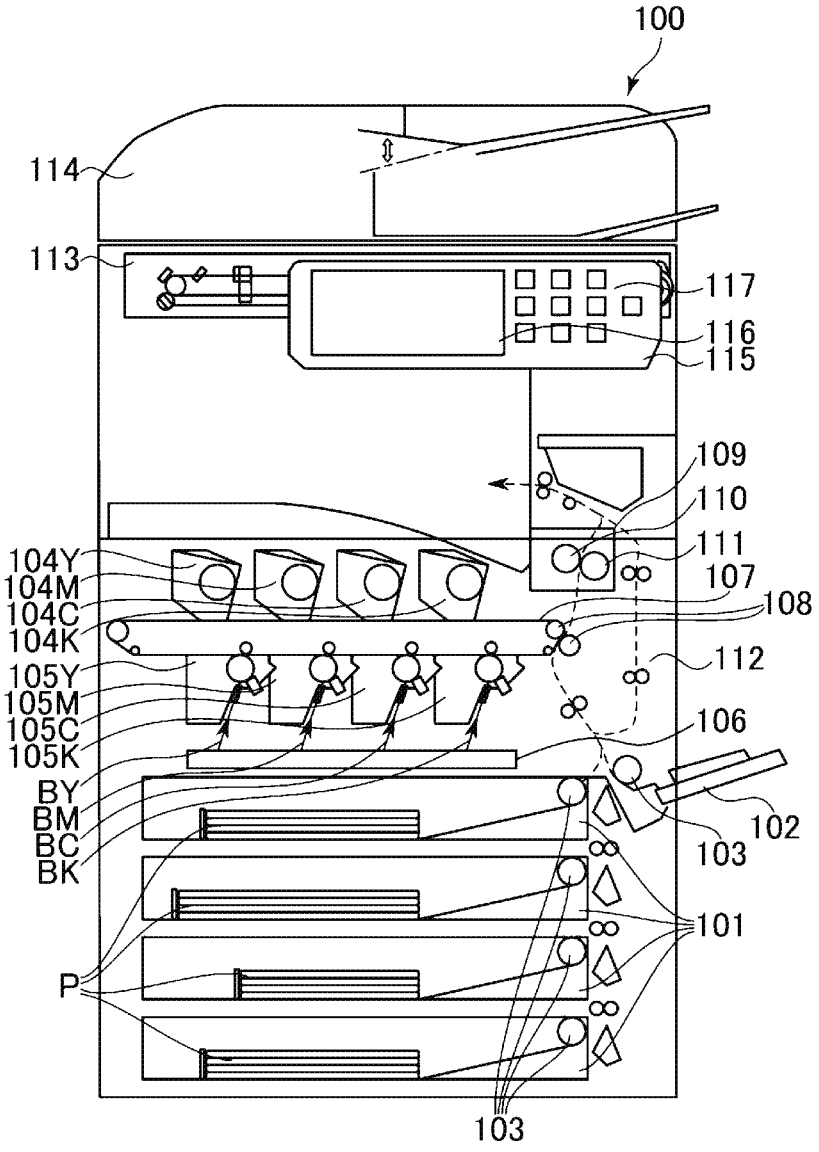
FIG. 1 is a diagram illustrating a schematic configuration of an image forming apparatus according to first to third embodiments.

In general, according to one embodiment, a control circuit for an image forming apparatus includes a plurality of beam sources each configured to emit a beam, a photodetector configured to detect an intensity of the beam emitted from the plurality of beam sources, a processor configured to measure a slope efficiency of each beam source by controlling each beam source to emit the beam with different drive currents, and acquiring the intensity of each beam detected by the photodetector, and while a job is performed by the image forming apparatus, detect a current flowing in each beam source, determine an adjustment amount of a drive current for each beam source so that the beam source emits the beam at a predetermined output, based on the detected current and the measured slope efficiency, and adjust the drive current with the determined adjustment amount.

Hereinafter, an image forming apparatus according to embodiments will be described with reference to the accompanying drawings. Further, each drawing used for the description of the following embodiments may be appropriately modified with respect to the scale of each unit. Further, each drawing used for the description of the following embodiments may be illustrated by omitting a configuration for the description. Further, the same components will be denoted by the same reference signs in the drawings and the following descriptions.

First Embodiment

FIG. 1 is a diagram illustrating a schematic configuration of an image forming apparatus 100 according to a first embodiment.

The image forming apparatus 100 is, for example, a multifunction peripheral (MFP), a copying machine, a printer, a facsimile, or the like. However, hereinafter, the image forming apparatus 100 will be described as an MFP. The image forming apparatus 100 includes, for example, a printing function, a scanning function, a copying function, a decoloring function, a facsimile function, and the like. The printing function is a function of forming an image on an image forming medium P, and the like by using a recording material such as a toner, and the like. The image forming medium P is, for example, sheet-shaped paper, and the like. The scanning function is a function of reading an image from an original document, and the like on which the image is formed. The copying function is a function of printing, by using the printing function, the image read from the original document, and the like by using the scanning function on the image forming medium P. The decoloring function is a function of decoloring the image formed of a decolorable recording material on the image forming medium P. The image forming apparatus 100 includes, as an example, a paper feed tray 101, a manual feed tray 102, a paper feed roller 103, a toner cartridge 104, an image forming unit 105, an optical scanning apparatus 106, a transfer belt 107, a secondary transfer roller 108, a fixing unit 109, a heating unit 110, a pressure roller 111, a duplex unit 112, a scanner 113, an original document feeder 114, and an operation panel 115.

The paper feed tray 101 accommodates the image forming medium P used for printing.

The manual feed tray 102 is a tray for manually feeding the image forming medium P.

The paper feed roller 103 rotates by the action of a motor, thereby conveying the image forming medium P from the paper feed tray 101 toward the secondary transfer roller 108.

The toner cartridge 104 stores a recording material such as a toner, and the like to be supplied to the image forming unit 105. The image forming apparatus 100 includes a plurality of toner cartridges 104. The image forming apparatus 100 includes, for example, four toner cartridges 104 of a toner cartridge 104C, a toner cartridge 104M, a toner cartridge 104Y, and a toner cartridge 104K as illustrated in FIG. 1. The toner cartridge 104C, the toner cartridge 104M, the toner cartridge 104Y, and the toner cartridge 104K respectively store cyan, magenta, yellow, and key (black) (CMYK) recording materials. Further, the colors of the recording materials stored in the toner cartridges 104 are not limited to each color of CMYK, and may be other colors. Further, the recording material stored in the toner cartridge 104 may be a special recording material. For example, the toner cartridge 104 stores a decolorable recording material which is decolored at a temperature higher than a predetermined temperature to become an invisible state.

The image forming apparatus 100 includes a plurality of image forming units 105. As illustrated in FIG. 1, the image forming apparatus 100 includes, as an example, four image forming units 105 of an image forming unit 105C, an image forming unit 105M, an image forming unit 105Y, and an image forming unit 105K. The image forming unit 105C, the image forming unit 105M, the image forming unit 105Y, and the image forming unit 105K respectively form an image with cyan, magenta, yellow, and key (black) recording material.

Figure 2:
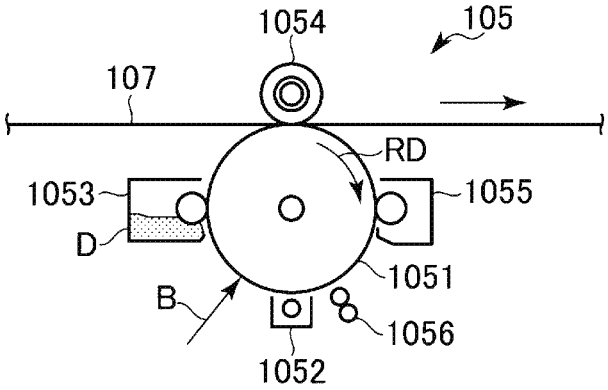
FIG. 2 is a diagram illustrating a schematic configuration of the image forming unit shown in FIG. 1.

The image forming unit 105 will be further described with reference to FIG. 2. FIG. 2 is a diagram illustrating a schematic configuration of the image forming unit 105. The image forming unit 105 includes, as an example, a photoreceptor drum 1051, a charging unit 1052, a developing unit 1053, a primary transfer roller 1054, a cleaner 1055, and a discharge lamp 1056.

Abeam B emitted from the optical scanning apparatus 106 hits the photoreceptor drum 1051. Accordingly, an electrostatic latent image is formed on a surface of the photoreceptor drum 1051.

The charging unit 1052 charges a predetermined positive charge on the surface of the photoreceptor drum 1051.

The developing unit 1053 develops the electrostatic latent image formed on the surface of the photoreceptor drum 1051 by using a recording material D supplied from the toner cartridge 104. Accordingly, an image by the recording material D is formed on the surface of the photoreceptor drum 1051.

The primary transfer roller 1054 is disposed at a position opposite to the photoreceptor drum 1051 with the transfer belt 107 interposed therebetween. The primary transfer roller 1054 generates a transfer voltage between the primary transfer roller 1054 itself and the photoreceptor drum 1051. Accordingly, the primary transfer roller 1054 transfers the image formed on the surface of the photoreceptor drum 1051 on the transfer belt 107 which is in contact with the photoreceptor drum 1051 (i.e., primary transfer).

The cleaner 1055 removes the recording material D remaining on the surface of the photoreceptor drum 1051.

The discharge lamp 1056 removes charges remaining on the surface of the photoreceptor drum 1051.

Figure 3:
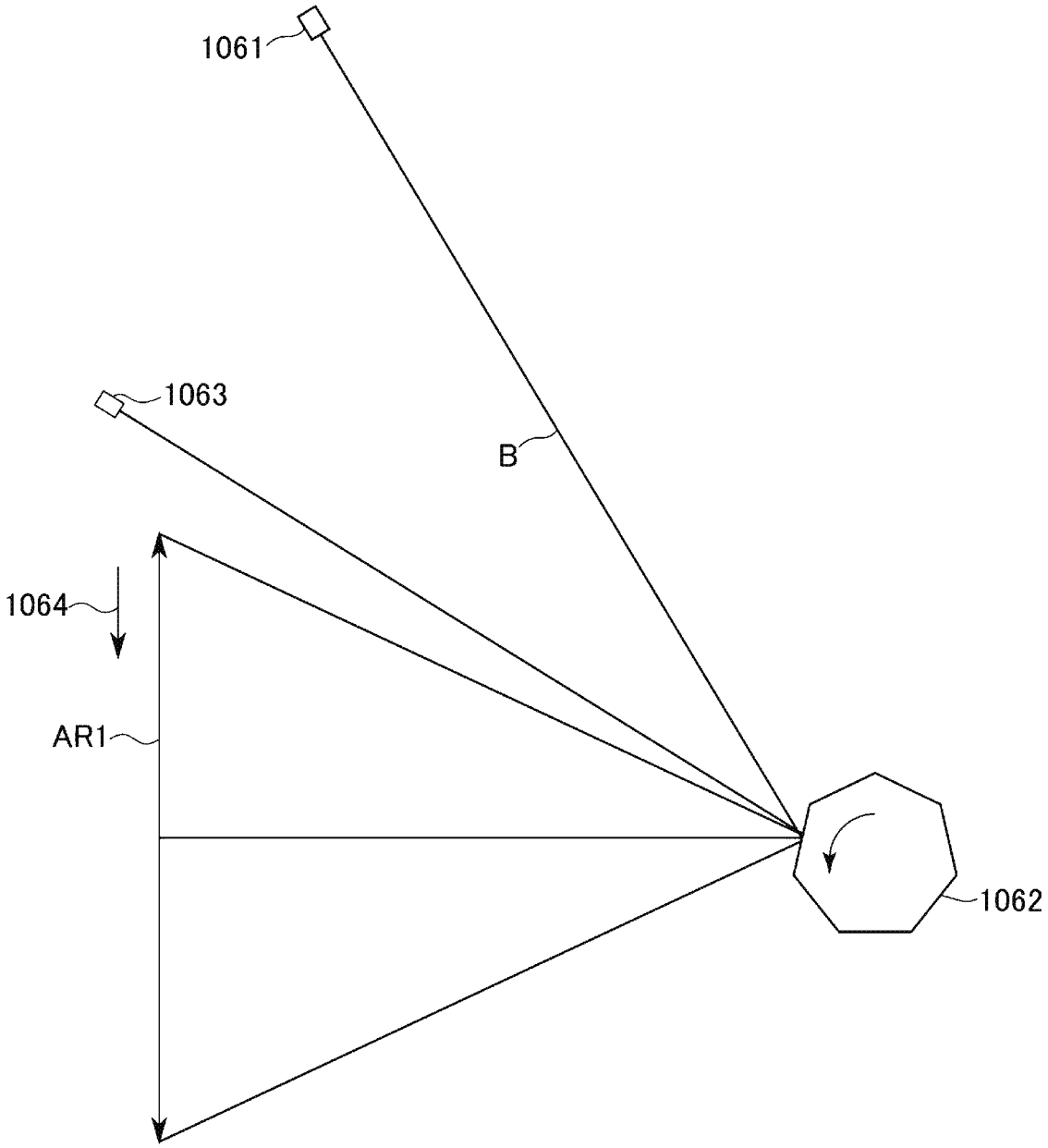
FIG. 3 is a diagram illustrating the light scanning apparatus shown in FIG. 1.

The optical scanning apparatus 106 will be described with reference to FIG. 3. FIG. 3 is a diagram illustrating the optical scanning apparatus 106. The optical scanning apparatus 106 is also referred to as a laser scanning unit (LSU). The optical scanning apparatus 106 forms an electrostatic latent image on the surface of the photoreceptor drum 1051 of each image forming unit 105 by controlling the beam B according to image data input to the image forming apparatus 100. The image data input thereto are, for example, image data read from an original document, or the like by the scanner 113. Alternatively, the image data input thereto are image data transmitted from other apparatuses, and the like and received by the image forming apparatus 100.

The optical scanning apparatus 106 includes a light source 1061, a polygon mirror 1062, and a beam detect (BD) sensor 1063.

The light source 1061 emits the beam B such as a laser beam. The light source 1061 includes a plurality of laser diodes. The beam B is a multi-beam formed of a plurality of beams emitted from the plurality of laser diodes. Further, the optical scanning apparatus 106 includes, for example, four light sources 1061 including a light source 1061C, a light source 1061M, a light source 1061Y, and a light source 1061K. The light source 1061C emits a beam BC corresponding to a cyan (C) component of the image data. The beam BC irradiates the surface of the photoreceptor drum 1051 of the image forming unit 105C. The light source 1061M emits a beam BM corresponding to a magenta (M) component of the image data. The beam BM irradiates the surface of the photoreceptor drum 1051 of the image forming unit 105M. The light source 1061Y emits a beam BY corresponding to a yellow (Y) component of the image data. The beam BY irradiates the surface of the photoreceptor drum 1051 of the image forming unit 105Y. The light source 1061K emits a beam BK corresponding to a key (K) component of the image data. The beam BK irradiates the surface of the photoreceptor drum 1051 of the image forming unit 105K.

The polygon mirror 1062 is a regular polygonal columnar mirror or deflector whose respective side surfaces are reflecting surfaces that reflect the laser. The polygon mirror 1062 is a regular seven columnar mirror having seven reflecting surfaces 131*a* as one example. The seven reflecting surfaces 131*a* provided in the polygon mirror 1062 continue along a rotational direction of the polygon mirror 1062 (i.e., counterclockwise direction in FIG. 3), and form an outer peripheral surface of the polygon mirror 1062. The polygon mirror 1062 is rotatable about a rotation axis parallel to each of reflecting surfaces 131*a*. The polygon mirror 1062 rotates by the action of a motor.

The optical scanning apparatus 106 reflects the beam B emitted from the light source 1061 on the reflecting surface of the rotating polygon mirror 1062. Accordingly, the beam B is deflected in a main scanning direction 1064 along the rotational direction of the polygon mirror 1062. Next, the beam B scans an image surface AR1 which is a predetermined area among the surfaces of the photoreceptor drum 1051 in the main scanning direction 1064 at a predetermined linear speed. At this time, the image forming apparatus 100 rotates the photoreceptor drum 1051 in a sub-scanning direction. Accordingly, an electrostatic latent image corresponding to a color component is formed on the image surface AR1. Further, here, the direction in which the beam B is deflected or scanned by the polygon mirror 1062 (i.e., the peripheral direction of the polygon mirror 1062) is defined as the main scanning direction 1064. Further, a direction orthogonal to the main scanning direction 1064 and orthogonal to an optical axis direction of the beam B is defined as the sub-scanning direction of the beam B.

The BD sensor 1063 is disposed at an end part of a scanning start part of the beam B. The BD sensor 1063 is provided for aligning horizontal synchronization of the beam B. The BD sensor 1063 outputs a BD signal in response to the incidence of the beam B.

Referring back to FIG. 1, the description will continue. The transfer belt 107 is, for example, an endless belt and is rotatable by the action of a roller. The transfer belt 107 conveys the image transferred from each of image forming units 105 to a position of the secondary transfer roller 108 by the rotation thereof.

The secondary transfer roller 108 includes two rollers opposite to each other. The secondary transfer roller 108 transfers the image formed on the transfer belt 107 on the image forming medium P passing between the secondary transfer rollers 108 (i.e., secondary transfer).

The fixing unit 109 heats and pressurizes the image forming medium P on which the image is transferred. Accordingly, the image transferred on the image forming medium P is fixed. The fixing unit 109 includes the heating unit 110 and the pressure roller 111 which are opposite to each other.

The heating unit 110 is, for example, a roller including a heat source for heating the heating unit 110. The heat source is, for example, a heater. The roller heated by the heat source conveys the heat to the image forming medium P.

Alternatively, the heating unit 110 may include an endless belt suspended by a plurality of rollers. For example, the heating unit 110 includes a plate-shaped heat source, an endless belt, a belt conveyance roller, a tension roller, and a press roller. The endless belt is, for example, a film-shaped member. The belt conveyance roller drives the endless belt. The tension roller applies tension to the endless belt. In the press roller, an elastic layer is formed on the surface thereof. The heat generation unit side of the plate-shaped heat source contacts the inside of the endless belt and is pressed toward a direction of the press roller, thereby forming a fixing nip with a predetermined width between the plate-shaped heat source itself and the press roller. Since the plate-shaped heat source is configured to heat while forming a nip area, the responsiveness at the time of energization is higher than that of a heating system by a halogen lamp.

The pressure roller 111 pressurizes the image forming medium P passing between the pressure roller 111 and the heating unit 110.

The duplex unit 112 allows printing on the back surface of the image forming medium P. For example, the duplex unit 112 reverses the front and back sides of the image forming medium P by switching back the image forming medium P by using a roller, and the like.

The scanner 113 is of an optical reduction type provided with an imaging element such as a charge-coupled device (CCD) image sensor, and the like. Alternatively, the scanner 113 is of a close-contact sensor (contact image Sensor (CIS)) type including the imaging element such as a complementary metal-oxide-semiconductor (CMOS) image sensor, and the like. Alternatively, the scanner 113 may be of another well-known type. The scanner 113 reads an image from an original document, and the like.

The original document feeder 114 is also referred to as, for example, an auto document feeder (ADF). The original document feeder 114 sequentially conveys the original documents placed on an original document tray. The image of the conveyed original document is read by the scanner 113. Further, the original document feeder 114 may include a scanner for reading an image from the back side of the original document.

The operation panel 115 includes a man-machine interface, and the like for performing the input and output between the image forming apparatus 100 and an operator of the image forming apparatus 100. The operation panel 115 includes, for example, a touch panel 116 and an input device 117.

The touch panel 116 is formed by laminating, for example, a display such as a liquid crystal display or an organic EL display, and the like and a pointing device by a touch input. The display provided in the touch panel 116 functions as a display device that displays a screen for notifying the operator of the image forming apparatus 100 of various types of information. Further, the touch panel 116 functions as an input device that receives a touch operation by the operator.

The input device 117 receives an operation by the operator of the image forming apparatus 100. The input device 117 is, for example, a keyboard, a keypad, or a touchpad, and the like.

Figure 4:
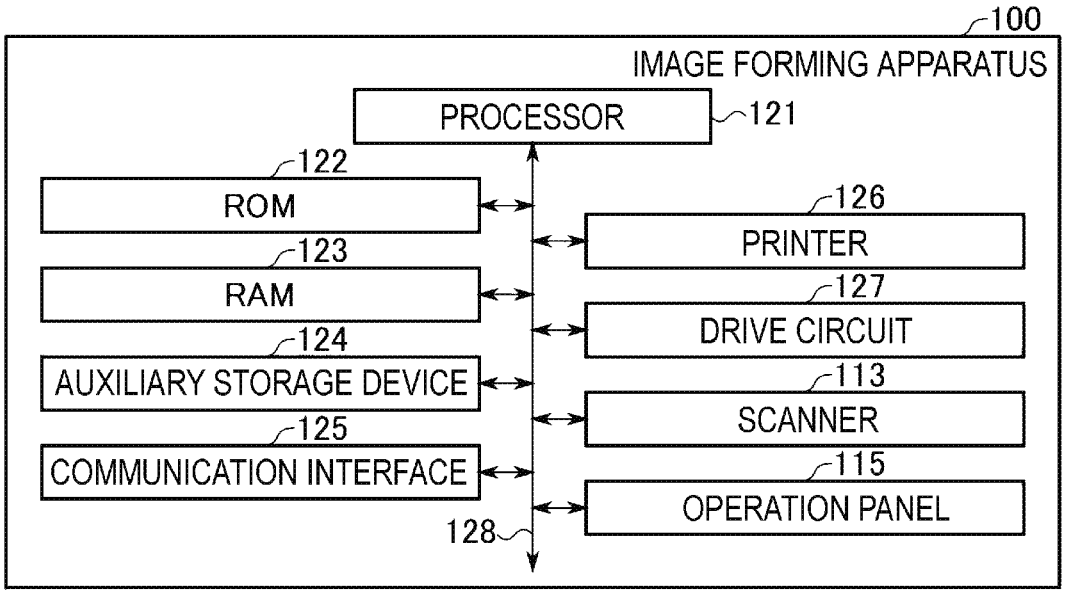
FIG. 4 is a block diagram illustrating a circuit configuration of the image forming apparatus.

Next, a circuit configuration of the image forming apparatus 100 will be described with reference to FIG. 4. FIG. 4 is a block diagram illustrating an example of a main part circuit configuration of the image forming apparatus 100. The image forming apparatus 100 includes, as an example, a processor 121, a read-only memory (ROM) 122, a random-access memory (RAM) 123, an auxiliary storage device 124, a communication interface 125, a printer 126, a drive circuit 127, the scanner 113, and the operation panel 115. Further, a bus 128, and the like connect the above-described respective units.

The processor 121 corresponds to a central part of a computer that executes processing such as calculation, control, and the like required for the operation of the image forming apparatus 100. The processor 121 controls each unit to perform various functions of the image forming apparatus 100 by executing programs such as firmware, system software, application software, and the like stored in the ROM 122, the auxiliary storage device 124, and the like. Further, a part or the whole of the programs may be incorporated in the circuit of the processor 121. For example, the processor 121 is a central processing unit (CPU), a micro processing unit (MPU), a system on a chip (SoC), a digital signal processor (DSP), a graphics processing unit (GPU), an application specific integrated circuit (ASIC), a programmable logic device (PLD), or a field-programmable gate array (FPGA), and the like. Alternatively, the processor 121 is a combination of a plurality thereof.

The ROM 122 corresponds to a memory of a computer having the processor 121. The ROM 122 is a non-volatile memory used exclusively for reading data. The ROM 122 stores, for example, firmware among the above-described programs. Further, the ROM 122 stores data used when the processor 121 executes various kinds of processing, or various setting values, and the like.

The RAM 123 corresponds to the main memory of the computer having the processor 121. The RAM 123 is a memory used for reading and writing data. The RAM 123 is used as a so-called work area and the like where data temporarily used when the processor 121 executes various kinds of processing are stored. The RAM 123 is, for example, a volatile memory.

The auxiliary storage device 124 corresponds to an auxiliary storage device of the computer having the processor 121. The auxiliary storage device 124 is, for example, an electric erasable programmable read-only memory (EEPROM), a hard disk drive (HDD), a solid state drive (SSD), an embedded multimedia card (eMMC), and the like. The auxiliary storage device 124 stores, for example, system software, application software, and the like among the above-described programs. Further, the auxiliary storage device 124 stores the data used when the processor 121 executes various kinds of processing, data generated by the processing executed by the processor 121, various kinds of setting values, and the like. Further, the image forming apparatus 100 may include an interface through which a storage medium such as a memory card or a universal serial bus (USB) memory, and the like can be inserted as the auxiliary storage device 124. The interface reads and writes information from and to the storage medium.

The program stored in the ROM 122 or the auxiliary storage device 124 includes a program for executing processing which will be described later. As one example, the image forming apparatus 100 is transferred to an administrator, and the like of the image forming apparatus 100 in a state where the program is stored in the ROM 122 or the auxiliary storage device 124. However, the image forming apparatus 100 may be transferred to the administrator, and the like in a state where the program is not stored in the ROM 122 or the auxiliary storage device 124. Further, the image forming apparatus 100 may be transferred to the administrator, and the like in a state where a program different from the above-mentioned program is stored in the ROM 122 or the auxiliary storage device 124. Further, the program for executing the processing which will be described later may be separately provided to the administrator, and the like, and may be written into the ROM 122 or the auxiliary storage device 124 under the operation by the administrator, a service man, or the like. In this case, the program may be provided via, for example, a removable storage medium such as a magnetic disk, a magneto-optical disk, an optical disk, or a semiconductor memory, and the like, or a network, or the like such as the Internet or a local area network (LAN), and the like.

The communication interface 125 is an interface for the image forming apparatus 100 to communicate via a network, and the like.

The printer 126 performs printing on the image forming medium P. The printer 126 includes, for example, the toner cartridge 104, the image forming unit 105, the optical scanning apparatus 106, the transfer belt 107, the secondary transfer roller 108, the fixing unit 109, and the duplex unit 112.

The drive circuit 127 is a circuit for operating the light source 1061.

The bus 128 includes a control bus, an address bus, a data bus, and the like, and transmits a signal transmitted from and received to each unit of the image forming apparatus 100.

Figure 5:
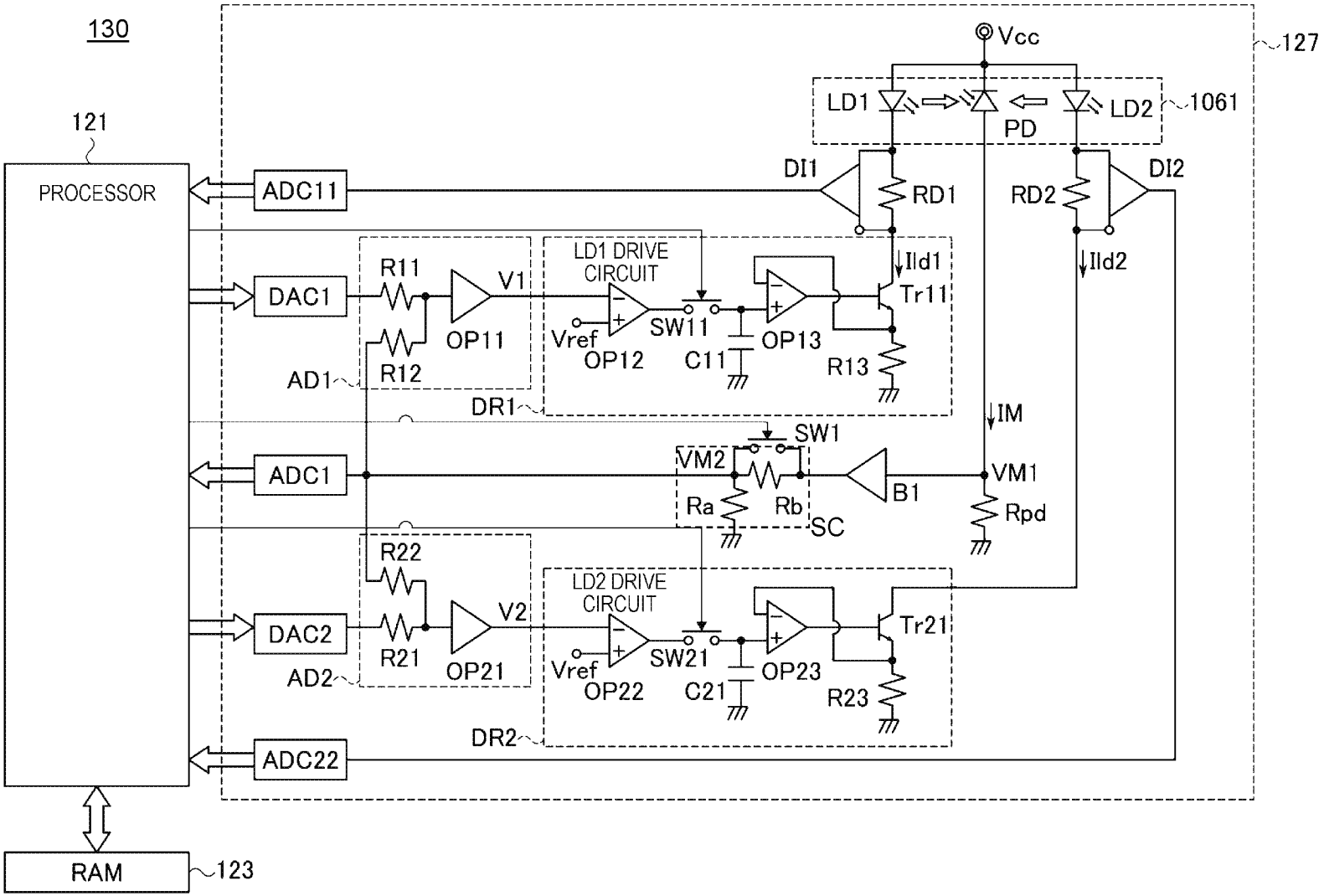
FIG. 5 is a circuit diagram of a drive circuit according to the first to third embodiments.

The drive circuit 127 will be described with reference to FIG. 5. FIG. 5 is a circuit diagram illustrating an example of the drive circuit 127. Further, the image forming apparatus 100 includes one drive circuit 127 for each light source 1061.

As an example, the drive circuit 127 includes, the light source 1061, a resistance Rpd, a buffer circuit B1, a switch SW1, a resistance Ra, a resistance Rb, a circuit ADC1, an adder circuit AD1, a circuit DAC1, an LD1 drive circuit DR1, a resistance RD1, a circuit DI1, a circuit ADC11, an adder circuit AD2, a circuit DAC2, an LD2 drive circuit DR2, a resistance RD2, a circuit DI2, and a circuit ADC22. The drive circuit 127 is connected to the processor 121. The processor 121 is connected to the RAM 123. In one embodiment, the processor 121, the RAM 123, and the drive circuit 127 make up a control circuit 130.

As an example, the light source 1061 includes a laser diode LD1, a laser diode LD2, and a photodiode PD. Therefore, in this case, the light source 1061 emits two beams.

The laser diode LD1 and the laser diode LD2 are collectively referred to as a laser diode LD. As an example, the laser diode LD includes two emission end surfaces opposite to each other. The two emission end surfaces emit laser beams. The two beams are referred to as a main beam and a sub-beam. The main beam is emitted from the laser diode LD and forms the beam B. Therefore, the beam B is formed of the main beam of the laser diode LD1 and the main beam of the laser diode LD2. The sub-beam is a beam for monitoring an output of the laser diode LD1. The light source 1061 is formed so that the sub-beam is incident on the photodiode PD. The magnitude of the output of the sub-beam is proportional to the magnitude of the output of the main beam. Further, hereinafter, "the magnitude of the output of the main beam of the laser diode LD" is simply referred to as "the output of the laser diode LD".

The photodiode PD is a photodiode for monitoring the laser diode LD. The photodiode PD outputs a current IM corresponding to the intensity of incident light. As described above, the sub-beam emitted from each laser diode LD is incident on the photodiode PD. Therefore, the photodiode PD outputs the current IM corresponding to the magnitude of the output of the beam emitted from the laser diode LD.

The resistance Rpd is provided for measuring a magnitude of the current IM.

The buffer circuit B1 outputs a voltage VM1 at both ends of the resistance Rpd. The voltage VM1 indicates the output of the beam to be input to the photodiode PD. Further, when two or more beams are incident on the photodiode PD, the voltage VM1 indicates a total output thereof.

The switch SW1 switches between an open state and a closed state by the control of the processor 121. The switch SW1 is connected in parallel with a resistance Rb. In the closed state, the switch SW1 short-circuits both ends of the resistance Rb, thereby allowing a current output from the buffer circuit B1 to flow to the switch SW1 without flowing to the resistance Rb. In the open state, the switch SW1 allows the current output from the buffer circuit B1 to flow to the resistance Rb.

The resistances Ra and Rb divide the voltage VM1 output from the buffer circuit B1 when the switch SW1 is in the closed state. When a ratio of the resistance values of the resistance Ra and the resistance Rb is defined as a:b, a voltage VM2 at both ends of the resistance Ra is $(a/(a+b))\cdot VM1$ when the switch SW1 is in the closed state. Therefore, the resistances Ra and Rb function as gain control that reduces the voltage input from the buffer circuit B1 at a fixed ratio and outputs the reduced voltage to the circuit ADC1 when the switch SW1 is in the closed state. Further, the voltage VM2 indicates the output of the beam to be input to the photodiode PD. In one embodiment, the resistances Ra and Rb make up a suppression circuit SC.

The voltage VM1 output from the buffer circuit B1 is applied to both ends of the resistance Ra when the switch SW1 is in the open state. Therefore, VM2=VM1.

The Voltage VM2 at both ends of the resistance Ra is input to the circuit ADC1. The circuit ADC1 is an A/D (analog-to-digital) conversion circuit that converts an input analog signal into a digital signal and then inputs the converted digital signal to the processor 121. Therefore, the circuit ADC1 inputs the digital signal indicating the voltage VM2 to the processor 121.

The voltage VM2 is either one of a value of VM1 and a value of $(a/(a+b))\cdot VM1$ according to the open and closed state of the switch SW1. Accordingly, the processor 121 can specify the intensity of the light to be input to the photodiode PD from the voltage indicated by the digital signal input from the circuit ADC1 and the open and closed state of the switch. Further, even though the light input to the photodiode PD is the sub-beam of the laser diode LD, the intensity of the sub-beam is proportional to the main beam, and therefore, the processor 121 can also recognize the intensity of light of the main beam output from the laser diode LD. However, the value recognized herein by the processor 121 is a value obtained by adding the intensities of the light of the plurality of main beams when the plurality of laser diodes LD emit light at the same time.

The circuit DAC1 is a D/A (digital-to-analog) conversion circuit that converts a digital signal output from the processor 121 into an analog signal and then outputs the converted analog signal.

The adder circuit AD1 is an adder circuit configured by including a resistance R11, a resistance R12, and an operational amplifier OP11. The adder circuit AD1 adds a voltage output from the circuit DAC1 and the voltage VM2, and then outputs the added voltage to the LD1 drive circuit DR1. The voltage output from the adder circuit AD1 is defined as V1.

The LD1 drive circuit DR1 is a circuit that drives the laser diode LD1. The LD1 drive circuit DR1 stabilizes the output of the laser diode LD1. The LD1 drive circuit DR1 controls the magnitude of the output of the laser diode LD1. The LD1 drive circuit DR1 includes, as an example, an operational amplifier OP12, a switch SW11, a capacitor C11, an operational amplifier OP13, a transistor Tr11, and a resistance R13.

An output terminal of the adder circuit AD1 is connected to an inverting input terminal of the operational amplifier OP12. A reference voltage Vref is input to a non-inverting input terminal of the operational amplifier OP12. The operational amplifier OP12 is a comparator that compares the voltage V1 output from the adder circuit AD1 with the reference voltage Vref and outputs a comparison result. When the voltage V1 is larger than the reference voltage Vref, the operational amplifier OP12 outputs a signal that makes a current I1*d*1 small. When the voltage V1 is smaller than the reference voltage Vref, the operational amplifier OP12 outputs a signal that makes the current I1*d*1 large.

The switch SW11 switches between the open state and the closed state by the control of the processor 121. When the switch SW11 is in the closed state, the output of the operational amplifier OP12 is input to a non-inverting input terminal of the operational amplifier OP13. When the switch SW11 is in the open state, the output of the operational amplifier OP12 is not input to the operational amplifier OP13.

The capacitor C11 stabilizes the voltage input to the operational amplifier OP13.

An emitter of the transistor Tr11 and the resistance R13 are connected to an inverting input terminal of the operational amplifier OP13. A base of the transistor Tr11 is connected to an output of the operational amplifier OP13. The current I1*d*1 corresponding to an output voltage of the operational amplifier OP12 flows through the laser diode LD1, the resistance RD1, and the transistor Tr11 by the operational amplifier OP13, the transistor Tr11, and the resistance R13.

The resistance RD1 is provided for measuring the current I1*d*1 flowing through the laser diode LD1.

The circuit DI1 is connected to both ends of the resistance RD1. The circuit DI1 outputs the voltage at both ends of the resistance RD1 to the circuit ADC11.

The circuit ADC11 is an A/D conversion circuit that converts an input analog signal into a digital signal and then inputs the converted digital signal to the processor 121. Therefore, the circuit ADC11 inputs the digital signal indicating the voltage at both ends of the resistance RD1 to the processor 121.

The circuit DAC2 is a D/A conversion circuit that converts a digital signal output from the processor 121 into an analog signal and then outputs the converted analog signal.

The adder circuit AD2 is an adder circuit including a resistance R21, a resistance R22, and an operational amplifier OP21. The adder circuit AD2 adds a voltage output from the circuit DAC2 and the voltage VM2 and outputs the added voltage to the LD2 drive circuit DR2. The voltage output by the adder circuit AD2 is defined as V2.

The LD2 drive circuit DR2 is a circuit that drives the laser diode LD2. The LD2 drive circuit DR2 stabilizes the output of the laser diode LD2. The LD2 drive circuit DR2 controls the magnitude of the output of the laser diode LD2. The LD2 drive circuit DR2 includes, as an example, an operational amplifier OP22, a switch SW21, a capacitor C21, an operational amplifier OP23, a transistor Tr21, and a resistance R23.

An output terminal of the adder circuit AD2 is connected to an inverting input terminal of the operational amplifier OP22. The reference voltage Vref is input to a non-inverting input terminal of the operational amplifier OP22. The operational amplifier OP22 is a comparator that compares the voltage V2 output from the adder circuit AD2 with the reference voltage Vref and outputs a comparison result. When the voltage V2 is larger than the reference voltage Vref, the operational amplifier OP22 outputs a signal that makes a current I1*d*2 small. When the voltage V2 is smaller than the reference voltage Vref, the operational amplifier OP22 outputs a signal that makes the current I1*d*2 large.

The switch SW21 switches between the open state and the closed state by the control of the processor 121. When the switch SW21 is in the closed state, the output of the operational amplifier OP22 is input to a non-inverting input terminal of the operational amplifier OP23. When the switch SW21 is in the open state, the output of the operational amplifier OP22 is not input to the operational amplifier OP23.

The capacitor C21 stabilizes the voltage input to the operational amplifier OP23.

The emitter of the transistor Tr21 and the resistance R23 are connected to an inverting input terminal of the operational amplifier OP23. The base of the transistor Tr21 is connected to an output of the operational amplifier OP23. The current I1*d*2 corresponding to an output voltage of the operational amplifier OP22 flows through the laser diode LD2, the resistance RD2, and the transistor Tr21 by the operational amplifier OP23, the transistor Tr21, and the resistance R23.

The resistance RD2 is provided for measuring the current I1*d*2 flowing through the laser diode LD2.

The circuit DI2 is connected to both ends of the resistance RD2. The circuit DI2 outputs the voltage at both ends of the resistance RD2 to the circuit ADC22.

The circuit ADC22 is an A/D conversion circuit that converts an input analog signal into a digital signal and then inputs the converted digital signal to the processor 121. Therefore, the circuit ADC22 inputs the digital signal indicating the voltage at both ends of the resistance RD2 to the processor 121.

Further, the adder circuit AD1, the circuit DAC1, the LD1 drive circuit DR1, the resistance RD1, the circuit DI1, and the circuit ADC11 are collectively referred to as a circuit for LD1. Further, the adder circuit AD2, the circuit DAC2, the LD2 drive circuit DR2, the resistance RD2, the circuit DI2, and the circuit ADC22 are collectively referred to as a circuit for LD2. The circuit for LD2 includes the same elements as the circuit for LD1.

The drive circuit 127 described above is a circuit when the number of laser diodes LD provided in the light source 1061 is two. As described above, the number of laser diodes LD provided in the light source 1061 is not limited to two and may also be three or more. When three or more laser diodes LD are provided, the drive circuit 127 includes a circuit for LD3, a circuit for LD4, . . . , which include the same elements as the circuit for LD1 and the circuit for LD2.

Figure 6:
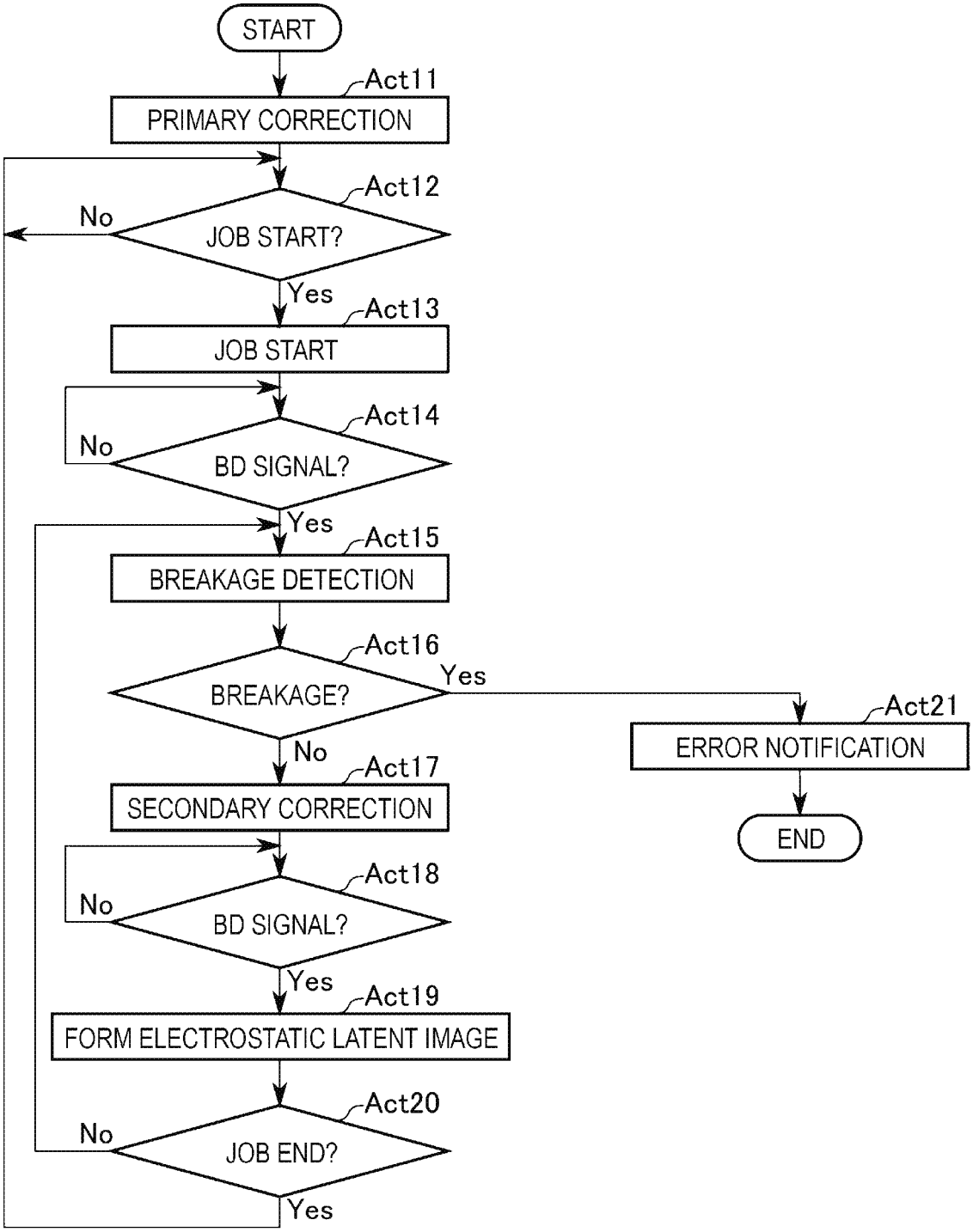
FIG. 6 is a flowchart illustrating a process performed by the image forming apparatus according to the first embodiment.

Hereinafter, an operation of the image forming apparatus 100 according to the first embodiment will be described with reference to FIG. 6. Further, hereinafter, a content of processing in the following operation description is an example, and various processing capable of acquiring the same result may be appropriately used. FIG. 6 is a flowchart illustrating a process executed by the processor 121 according to the first embodiment. The processor 121 executes the process, for example, by executing one or more programs stored in the ROM 122 or the auxiliary storage device 124, and the like.

The processor 121 performs the operation described below for each of the light sources 1061.

For example, the processor 121 starts the process illustrated in FIG. 6 at power-on of the image forming apparatus 100.

In Act11, the processor 121 executes primary correction. The processor 121 executes, for example, the primary correction as a part of an initial operation when the image forming apparatus 100 is powered on. The primary correction is an operation of obtaining the slope efficiency of each laser diode LD. For example, the processor 121 obtains the slope efficiency as follows.

The processor 121 causes the plurality of laser diodes LD provided in the light source 1061 to emit light two times at different outputs one by one. Here, a case in which the laser diode LD1 and the laser diode LD2 are both caused to emit light two times will be described as an example. Further, the processor 121 causes the laser diode LD to emit light, for example, so that light is emitted at a predetermined output. Alternatively, the processor 121 causes the laser diode LD to emit light so that a predetermined current flows through the laser diode LD. However, from a viewpoint of accuracy improvement, it is preferable to cause the laser diode LD to emit light so that light is emitted at the predetermined output.

An output of first light emission of the laser diode LD1 is defined as P11 [mW]. A current value of the current I1*d*1 flowing through the laser diode LD1 by the first light emission of the laser diode LD1 is defined as I11 [A]. An output of second light emission of the laser diode LD1 is defined as P12 [mW]. A current value of the current I1*d*1 flowing through the laser diode LD1 by the second light emission of the laser diode LD1 is defined as I12[A]. At this time, a characteristic curve of the slope efficiency of the laser diode LD1 is represented as shown in the following equation (1), where y is a variable indicating the output, and x is a variable indicating the current value.

[Equation 1]

$$y - P11 = \frac{P12 - P11}{I12 - I11} \cdot (x - I11) \tag{1}$$

When equation (1) is converted to a form of $y=\alpha x+\beta$, equation (1) is represented as shown in the following equation (2).

[Equation 2]

$$y = \frac{P12 - P11}{I12 - I11} x + \frac{P11 \cdot I12 - P12 \cdot I11}{I12 - I11} \tag{2}$$

An output of the first light emission of the laser diode LD2 is defined as P21 [mW]. A current value of the current I1*d*2 flowing through the laser diode LD2 by the first light emission of the laser diode LD2 is defined as I21[A]. An output of the second light emission of the laser diode LD2 is defined as P22 [mW]. A current value of the current I1*d*2 flowing through the laser diode LD2 by the second light emission of the laser diode LD2 is defined as I22[A]. At this time, a characteristic curve of the slope efficiency of the laser diode LD2 is represented as shown in the following equation (3) in the same manner as the case of the laser diode LD1.

[Equation 3]

$$y = \frac{P22 - P21}{I22 - I21} x + \frac{P21 \cdot I22 - P22 \cdot I21}{I22 - I21} \tag{3}$$

The processor 121 calculates the output using an equation indicating a characteristic curve of the slope efficiency of the third and subsequent laser diodes LD in the same manner.

Further, hereinafter, equation (2) may be represented as $y=\alpha 1 \cdot x+\beta 1$ by defining $\alpha 1=(P12-P11)/(I12-I11)$ and $\beta 1=(P11 \cdot I12-P12 \cdot I11)/(I12-I11)$. Further, equation (3) may be represented as $y=\alpha 2 \cdot x+\beta 2$ by defining $\alpha 2=(P22-P21)/(I22-I21)$ and $\beta 2=(P21 \cdot I22-P22 \cdot I21)/(I22-I21)$.

In Act12, the processor 121 determines whether or not to start a printing job. For example, the processor 121 determines to start a job in response to an input that instructs to execute a printing function. For example, the input is an operation input that instructs the operation panel 115 to execute printing or copying. Alternatively, the input is the printing job transmitted via a network and received by the communication interface 125. When the processor 121 does not determine to start the printing job, the processor 121 determines No in Act12 and repeats Act12. When the processor 121 determines to start the printing job, the processor 121 determines Yes in Act12 and proceeds to Act13.

The processor 121 starts the printing job in Act13.

Figure 7:
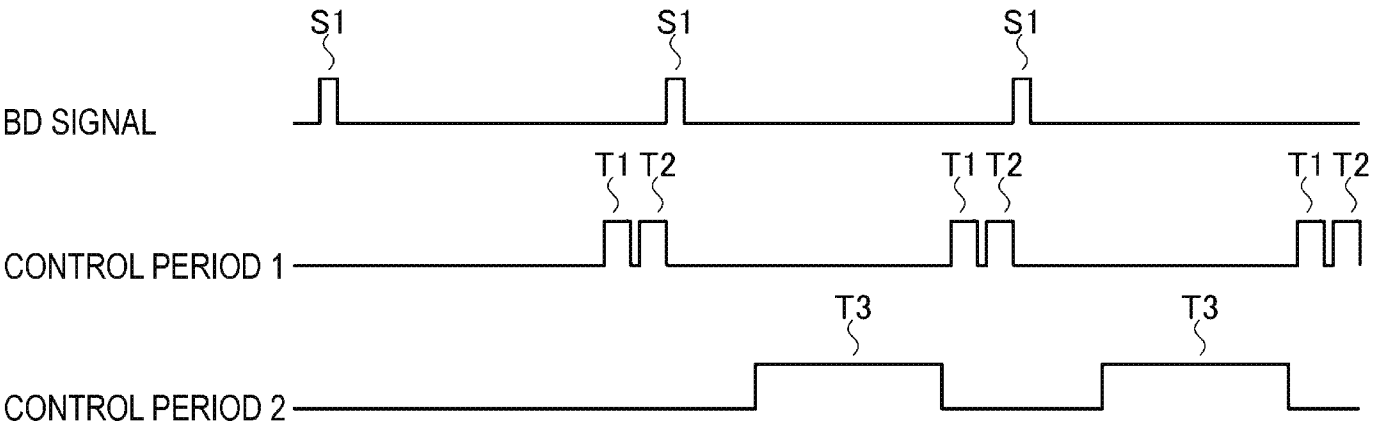
FIG. 7 is a timing diagram illustrating the timing of detecting breakage of a laser diode.

In Act14, the processor 121 waits for the BD sensor 1063 to output a BD signal. The timing of the BD signal and the control by the processor 121 will be described with reference to FIG. 7. FIG. 7 is a timing diagram illustrating the timing of the control by the processor 121. The BD signal S1 is illustrated in FIG. 7. When the BD sensor 1063 outputs the BD signal, the processor 121 determines Yes in Act14 in FIG. 6 and proceeds to Act15.

In Act15, the processor 121 detects breakage of each laser diode LD. Further, the processor 121 detects the breakage of each laser diode LD during a period T1 shown in FIG. 7. For example, the processor 121 detects the breakage of each laser diode LD as follows.

The processor 121 causes the plurality of laser diodes LD provided in the light source 1061 to emit light at the same time. At this time, it is desirable that the processor 121 causes the plurality of laser diodes LD to emit light with a rated output (i.e., without lowering the output of the laser diode LD). This is because a dynamic range can be increased more than a case where the laser diode LD emits light by lowering the output thereof by causing the laser diode LD to emit light at the rating, whereby a small change can be easily measured.

In such a manner that the plurality of laser diodes LD emit light at the same time, the current IM of the magnitude proportional to a value obtained by adding the outputs of the plurality of laser diodes LD flows through the photodiode. Further, as a result, the voltage VM1 proportional to the current IM is applied to both ends of the resistance Rpd. For example, when a voltage of 1 [V] per one laser diode LD is applied to both ends of the resistance Rpd, and the number of laser diodes LD provided in the light source 1061 is n (n is a natural number of two or more), the magnitude of the voltage VM1 is n [V]. However, the actual output of each laser diode LD is different due to the individual difference and the state of each laser diode LD. The processor 121 determines that either one of the laser diodes LD is broken when the magnitude of the voltage VM1 is equal to or less than a value obtained by multiplying n [V] by a fixed rate. The fixed rate is, as an example, 90%. The fixed rate is determined, for example, according to the number of laser diodes LD provided in the light source 1061, and the like. For example, when the number of laser diodes LD provided in the light source 1061 is n, and one laser diode LD fails to emit light due to the breakage thereof, the voltage VM1 ideally becomes the magnitude of ((n−1)/n). Therefore, the processor 121 can detect that one laser diode LD does not emit light when the fixed rate is a value sufficiently larger than the magnitude of ((n−1)/n). Here, the meaning of the sufficiently large value is that the value is large enough to detect that one laser diode LD does not emit light even though there is an error or an individual difference in the output of the laser diode LD.

Further, when the voltage VM1 is larger than an upper limit Vmax of the voltage that can be input to the circuit ADC1, the processor 121 sets the switch SW1 to the closed state and lowers the value of the voltage input to the circuit ADC1. Further, the upper limit Vmax of the voltage that can be input to the circuit ADC1 is, for example, a voltage of a power supply for operating the circuit ADC1. When the switch SW1 is in the closed state, a voltage of (a/(a+b)) n [V] is input to the circuit ADC1 by simultaneous light emission of the plurality of laser diodes LD. In other words, the voltage of (a/(a+b)) [V] is input to the circuit ADC1 per one laser diode LD.

Further, the circuit ADC1 has a resolution capable of detecting a potential difference equal to or less than (a/(a+b))·(½)=(a/(2(a+b))) [V] so as to know how many individual laser diodes LD emit light at the same time. Further, multiplying (a/(a+b)) by (½) is applied to prevent that an error is generated in the number of laser diodes LD emitting light due to a quantization error. Alternatively, multiplying (a/(a+b)) by (½) is applied to prevent that one laser diode LD is not detected when one laser diode LD is broken due to the quantization error.

In Act16 in FIG. 6, the processor 121 determines whether or not the breakage of the laser diode LD is detected in Act15. When the breakage of the laser diode LD is not detected, the processor 121 determines No in Act16 and proceeds to Act17.

In Act17, the processor 121 executes secondary correction. The secondary correction is the processing of setting the beam output from the laser diode LD to a desired intensity. Further, the processor 121 detects the breakage of each laser diode LD during a period T2 shown in FIG. 7. For example, the processor 121 executes the secondary correction as follows.

First, the secondary correction will be described with an example where the number of laser diodes LD provided in the light source 1061 is two.

The outputs of both the laser diode LD1 and the laser diode LD2 are set to P0. In this case, a total output of the two laser diodes LD is 2P0. Here, the output current IM of the photodiode PD when the total output of the two laser diodes LD is 2P0 is defined as 2·I0. In this case, the voltage VM1=2·I0·Rpd. Further, when the switch SW1 is in the open state, the voltage VM2=2·I0·Rpd. When the switch SW1 is in the closed state, the voltage VM2=2(a/(a+b))I0·Rpd. Therefore, the processor 121 sets the reference voltage Vref to 2·I0·Rpd and then sets the switch SW1 to the open state, or sets the reference voltage Vref to 2(a/(a+b))I0·Rpd and then sets the switch SW2 to the closed state. In this state, the processor 121 causes the laser diode LD1 and the laser diode LD2 to emit light at the same time. Then, the total output of the two laser diodes LD is changed by the action of the LD1 drive circuit DR1 and the LD2 drive circuit DR2. When the outputs of the two laser diodes LD are stabilized, the total output of the two laser diodes LD ideally becomes 2P0.

When the total output of the two laser diodes LD becomes 2P0 and currents I1*d*1 and I1*d*2 flowing through each laser diode LD are defined as Ia, the equation, 2P0=(α1+α2)Ia+(β1+β2) is derived from equations (2) and (3). Therefore, Ia=(2P0−(β1+β2))/(α1+α2). This value is a calculated value obtained by equations (2) and (3).

When the total output of the two laser diodes LD is stabilized, the processor 121 measures the current values of the current I1*d*1 and the current I1*d*2 from the values input from the circuit ADC11 and the circuit ADC22. The current value of the current I1*d*1 measured at this time is defined as Ia1 [A]. Further, the current value of the current I1*d*2 measured at this time is defined as Ia2 [A]. Ideally, the following relation holds: Ia1=Ia2=Ia. Further, as a reference, when Ia1=Ia2=Ia, the output P01 of the laser diode LD1 is P01=α1·Ia+β1. Further, the output P02 of the laser diode LD2 at this time is P02=α2·Ia+β2. Here, the processor 121 does not need to calculate P01 and P02.

Here, when the output of the laser diode LD1 is P0, the current value I01 [A] of the current I1*d*1 is P0=α1·I01+β1 by equation (2). Therefore, I01=(P0−β1)/α1. Further, when the output of the laser diode LD2 is P0, the current value I02 [A] of the current I1*d*2 is similarly I02=(P0−β2)/aλ by equation (2).

As described above, it can be understood that the output of the laser diode LD1 becomes P0 by increasing the current of I1*d*1 by IA1=(I01−Ia1). Further, it can be understood that the output of the laser diode LD2 becomes P0 by increasing the current of I1*d*2 by IA2=(I02−Ia2).

Therefore, the processor 121 outputs a voltage causing the current I1*d*1 to increase by IA1 from the circuit DAC1. Further, the processor 121 outputs a voltage causing the current I1*d*2 to increase by IA2 from the circuit DAC2. Accordingly, both the laser diode LD1 and the laser diode LD2 operate at the output of P0.

Figure 8:
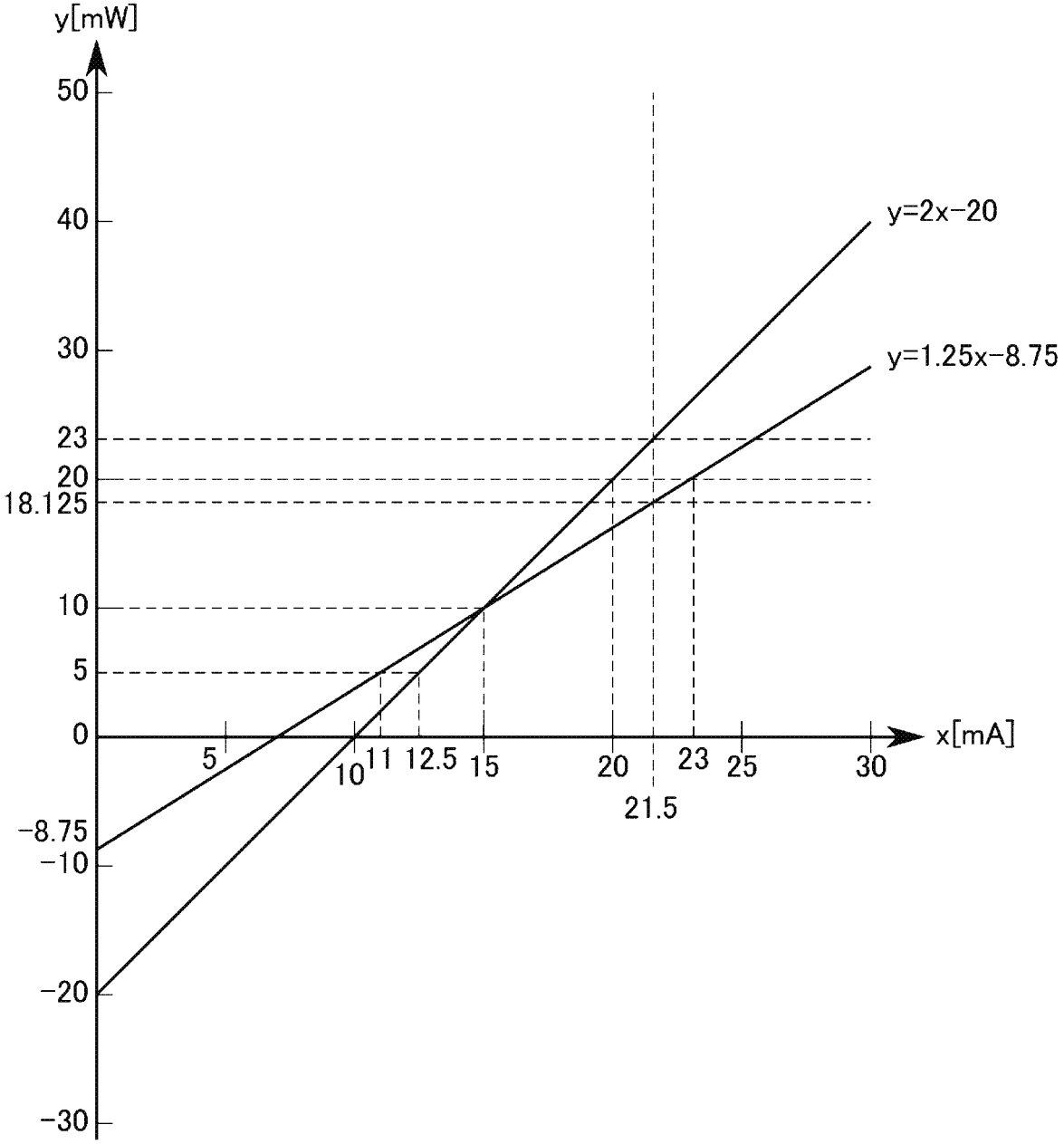
FIG. 8 is a graph illustrating a secondary correction operation.

Here, the secondary correction operation described above is confirmed by substituting a specific numerical value as illustrated in FIG. 8. FIG. 8 is a graph illustrating the secondary correction operation.

It is assumed that P11=5 [mW], I11=11 [mA], P12=10 [mW], and I12=15 [mA]. In this case, α1=1.25 and β1=−8.75.

It is assumed that P21=5 [mW], I21=12.5 [mA], P22=10 [mW], and I22=15 [mA]. In this case, α2=2 and β2=−20.

Further, it is assumed that P0=20 [mW].

In this case, a calculated value of Ia is Ia≈21.2 [mA]. Further, P01≈17.7 [mW], P02≈22.3 [mW]. In this case, P01+P02=40 [mW].

Further, I01=23 [mA], and I02=20 [mA].

However, the above-described value is not actually obtained due to an error, and the like. For example, it is assumed that the actually measured value of the current Ia is 21.5 [mA]. In this case, P01=18.125 [mW] and P02=23 [mW]. In this case, P01+P02=41.125 [mW], and there is a deviation from an ideal value. Further, the actually measured value is shown in FIG. 8. As described above, the processor 121 does not need to calculate P01 and P02.

Here, assuming that Ia1=Ia2=Ia, IA1=1.5 and IA2=−1.5, the processor 121 should output a voltage causing the current value of I1*d*1 to increase by 1.5 [mA] from the circuit DAC1, and output a voltage causing the current value of I1*d*2 to decrease by 1.5 [mA] from the circuit DAC2. Accordingly, both the laser diode LD1 and the laser diode LD2 operate at the output of 20 [mW].

A case in which the number of laser diodes LD is n will be described. The case of N is also the same as that of two.

It is assumed that each laser diode LD is operated by the output P0. In this case, the total output of n laser diodes is n·P0. At this time, when the current IM=n·I0, the voltage VM1=n·I0·Rpd. Further, when the switch SW1 is in the open state, the voltage VM2=n·I0·Rpd. On the other hand, when the switch SW1 is in the closed state, the voltage VM2=n (a/(a+b)) I0·Rpd. Therefore, the processor 121 sets the reference voltage Vref to n·I0·Rpd and then sets the switch SW1 to the open state, or sets the reference voltage Vref to n (a/(a+b))I0·Rpd and then sets the switch SW2 to the closed state. The processor 121 causes n laser diodes LD to emit light at the same time in this state. Then, the total output of n laser diodes LD is changed by the action of the drive circuit for each laser diode LD. When the output of n laser diodes LD is stabilized, the total output of n laser diodes LD becomes n·P0.

When the total output of n laser diodes LD is n·P0 and the current flowing through each laser diode LD is defined as Ia, n·P0 satisfies the relation of (α1+α2+α3+ . . . ) Ia+(β1+β2+β3+ . . . ). Therefore, Ia=(n·P0−(β1+β2+β3+ . . . ))/(α1+α2+α3+ . . . ). Further, an output P0*k* of the laser diode LDk at this time (where k is any natural number equal to or less than n) is P0*k*=αk·Ia+βk. Further, αk indicates an inclination α in the equation of the characteristic curve of the laser diode LDk. Further, βk indicates an intercept β in the equation of the characteristic curve of the laser diode LDk.

Here, when the output of the laser diode LDk is P0, a current value I0*k* [A] of a current Ik is P0=αk·I0*k*+βk. Therefore, I0*k*=(P0−βk)/αk.

As described above, it is understood that the output of the laser diode LDk becomes P0 by increasing the current of Ik by IAk=(I0*k*−Iak). Further, the IAK is an example of the adjustment amount of the drive current.

Therefore, the processor 121 outputs a voltage allowing the current of Ik to increase by IAk from the circuit DACk. Accordingly, any of the n laser diodes LD is operated at the output of P0.

In Act18 in FIG. 6, the processor 121 waits for the BD sensor 1063 to output the BD signal. When the BD sensor 1063 outputs the BD signal, the processor 121 determines Yes in Act18 and proceeds to Act19.

In Act 19, the processor 121 forms an electrostatic latent image on the image surface AR1 by controlling the beam B. The electrostatic latent image is formed during a period T3 shown in FIG. 7.

In Act20 in FIG. 6, the processor 121 determines whether or not to end the job. For example, the processor 121 determines to end the job in response to the completion of the formation of the electrostatic latent image for one job. When the processor 121 does not end the job, the processor 121 determines No in Act20 and returns to Act15. As described above, the processor 121 forms the electrostatic latent image during the period T3 after the BD signal S1 is output, detects the breakage of each laser diode LD during the period T1 after the end of the period T3, and executes the secondary correction during the period T2 after the end of the period T1.

On the other hand, when the processor 121 ends the job, the processor 121 determines Yes in Act20 and returns to Act12. Therefore, the processor 121 repeats Act15 to Act20 until determining to end the job.

Further, when the processor 121 detects the breakage of the laser diode LD, the processor 121 determines Yes in Act16 and proceeds to Act21.

In Act21, the processor 121 notifies that the laser diode LD is broken. For example, the processor 121 controls the operation panel 115 to display an image indicating that the laser diode LD is broken. Alternatively, the processor 121 may control a speaker to output a sound indicating that the laser diode LD is broken. After the processing of Act21, the processor 121 stops the job and ends the processing illustrated in FIG. 6.

The image forming apparatus 100 according to the first embodiment causes the plurality of laser diodes LD to emit light at the same time, thereby performing the secondary correction (APC control). Accordingly, the image forming apparatus 100 according to the first embodiment can reduce the time required for the APC control. It is known that the APC control takes time to charge the capacitor C11, the capacitor C21, and the like. According to the first embodiment, the image forming apparatus 100 can reduce the time required for the APC control by reducing the number of charging times.

Further, when the actually measured value of the total output of when the plurality of laser diodes LD are caused to simultaneously emit light is equal to or less than the fixed rate of the estimated value of the total output of when the plurality of laser diodes LD are caused to simultaneously emit light, the image forming apparatus 100 according to the first embodiment determines that the laser diode LD is broken. As a result, the image forming apparatus 100 according to the first embodiment can detect the breakage earlier than a case where the laser diode LD is caused to emit light one by one.

Second Embodiment

Since the image forming apparatus 100 according to a second embodiment has the same configuration as that of the image forming apparatus 100 according to the first embodiment, the description of the configuration will be omitted. However, the image forming apparatus 100 according to the second embodiment stores an LD database indicating a characteristic of the laser diode LD.

The LD database is generated in advance based upon the datasheet or the measured value, and the like of the laser diode LD. The LD database includes characteristic data indicating a forward voltage VF-forward current I1*d* characteristic for each of the laser diodes LD. For example, the processor 121 measures the characteristic data and then stores the measured characteristic data in the auxiliary storage device 124, and the like until the time of shipment such as the time of assembly at a factory, and the like. Further, for example, the processor 121 operates in a mode for performing setting before shipment or in a mode for maintenance, and the like, thereby executing the measurement of the characteristic data. Further, for example, the processor 121 operates in the mode according to an input made by an operator. Alternatively, the processor 121 may measure the characteristic data at another timing such as an initial operation or at the time of job start, and store the characteristic data in the auxiliary storage device 124, and the like. Further, alternatively, the image forming apparatus 100 may store the characteristic data generated, based upon the data sheet.

Figure 9:
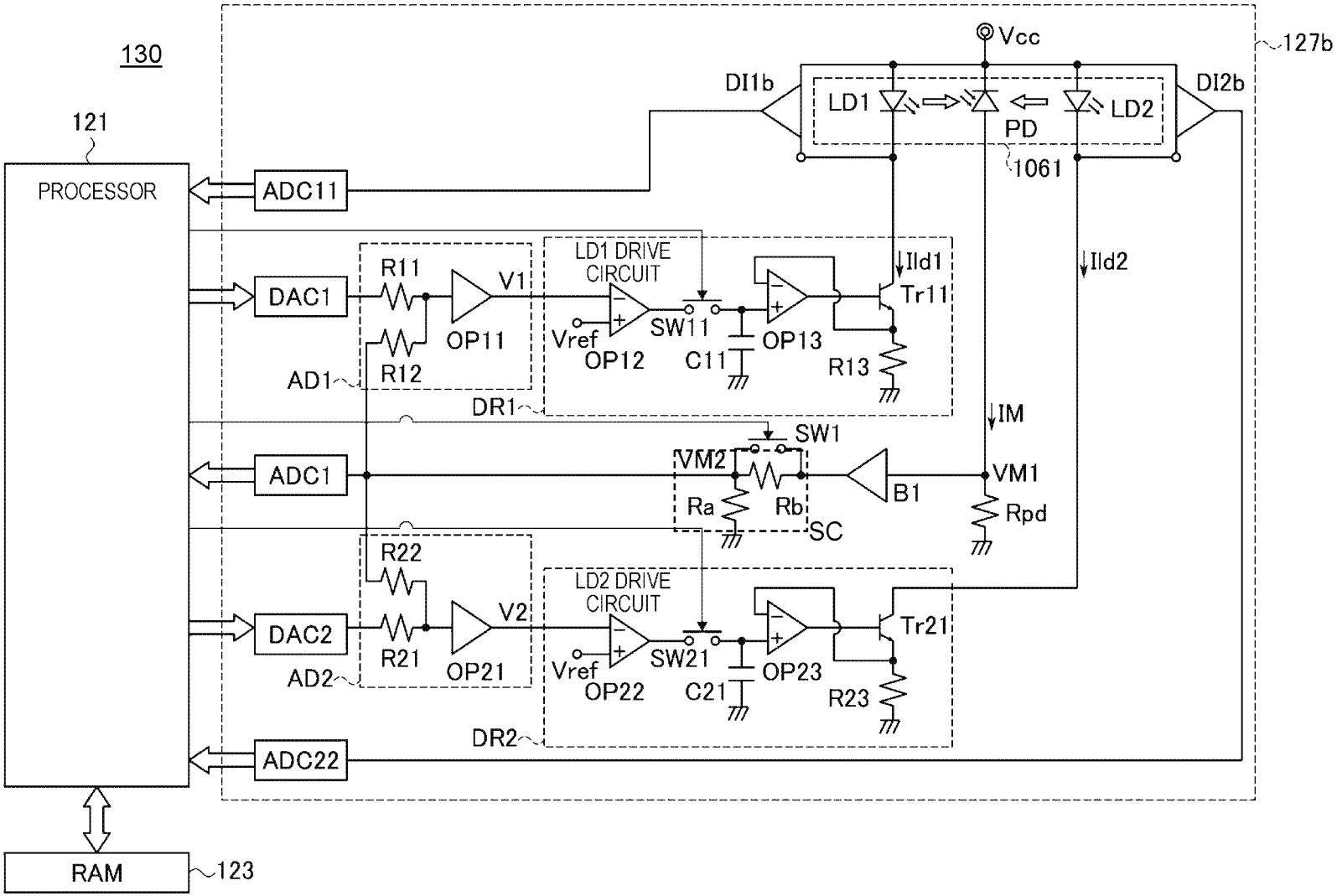
FIG. 9 is a circuit diagram of the drive circuit according to the second embodiment.

Further, the image forming apparatus 100 according to the second embodiment includes a drive circuit 127*b* instead of the drive circuit 127. A difference between the drive circuit 127*b* and the drive circuit 127 will be described with reference to FIG. 9. FIG. 9 is a circuit diagram illustrating an example of the drive circuit 127*b*.

The drive circuit 127*b* includes a circuit DI1*b* and a circuit DI2*b* instead of the circuit DI1 and the circuit DI2. In the circuit DI1*b*, a connection location of the circuit DI1 of the drive circuit 127 is changed. The circuit DI1*b* is connected to both ends of the laser diode LD1. The circuit DI1*b* outputs a forward voltage VF1 of the laser diode LD1 to the circuit ADC11. Therefore, in the drive circuit 127*b*, the circuit ADC11 inputs a digital signal indicating the forward voltage VF1 of the laser diode LD1 to the processor 121.

In the circuit DI2*b*, a connection location of the circuit DI2 of the drive circuit 127 is changed. The circuit DI2*b* is connected to both ends of the laser diode LD2. The circuit DI2*b* outputs a forward voltage VF2 of the laser diode LD2 to the circuit ADC22. Therefore, in the drive circuit 127*b*, the circuit ADC22 inputs a digital signal indicating the forward voltage VF2 of the laser diode LD2 to the processor 121.

Further, the drive circuit 127*b* is different from the drive circuit 127 of the first embodiment in that the drive circuit 127*b* does not include the resistance RD1 and the resistance RD2.

Figure 10:
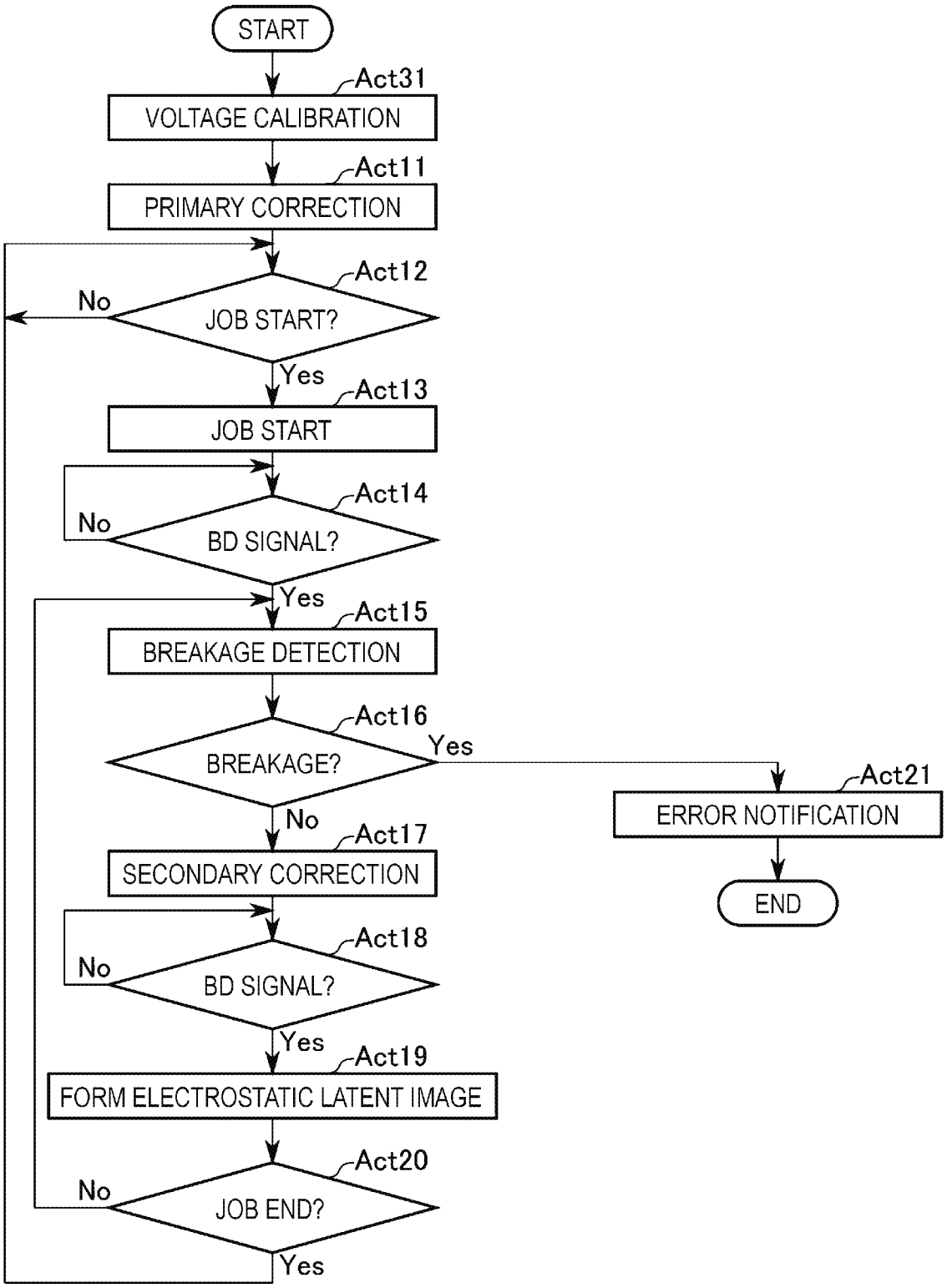
FIG. 10 is a flowchart illustrating a process according to the second embodiment.

Hereinafter, an operation of the image forming apparatus 100 according to the second embodiment will be described with reference to FIG. 10, and the like. Further, the content of the processing in the following operation description is an example, and various processing capable of obtaining the same result can be appropriately used. FIG. 10 is a flowchart illustrating a process performed by the processor 121 according to the second embodiment. The processor 121 executes the process, for example, by executing one or more programs stored in the ROM 122 or the auxiliary storage device 124, and the like.

The processor 121 performs an operation described below for each of the light sources 1061.

For example, the processor 121 starts the processing shown in FIG. 10 at power-on of the image forming apparatus 100.

In Act31, the processor 121 executes voltage calibration. The processor 121 executes the voltage calibration, for example, as a part of an initial operation when the image forming apparatus 100 is powered on. For example, the processor 121 executes the voltage calibration one by one for each laser diode LD as follows.

As an example, the voltage calibration of the laser diode LD1 will be described.

The processor 121 sets the reference voltage Vref to 0. Accordingly, the laser diode LD1 is powered off. The processor 121 increases the reference voltage Vref from 0 while confirming the output of the laser diode LD1, and increases the output of the laser diode LD1 up to PV1. Then, the processor 121 measures a forward voltage VF11 of the laser diode LD1. Further, the processor 121 obtains a current I1*d*1*l* flowing through the laser diode LD1 from characteristic data indicating a forward voltage VF11-forward current I1*d*1*l* characteristic of the laser diode LD1 included in the LD database.

Further, the processor 121 increases the reference voltage Vref while confirming the output of the laser diode LD, and increases the output of the laser diode LD up to PV2. Next, the processor 121 measures a forward voltage VF12 of the laser diode LD. Further, the processor 121 obtains a current I1*d*12 flowing through the laser diode LD1 from characteristic data indicating a forward voltage VF12-forward current I1*d*12 characteristic of the laser diode LD2 included in the LD database.

The current I1*d*1 and the voltage VF1 have a relationship of I1*d*1=Mv1·VF1, where Mv1 is a proportional constant. From the above-described measurement results, the processor 121 obtains Mv1 calculated by the equation (PV2−PV1)/(I1*d*12−I1*d*1*l*)).

In the same manner, the processor 121 obtains a proportional constant Mv between the current I1*d* and the voltage VF for each laser diode LD. Here, I1*d* is calculated by Mv·VF.

The processor 121 can obtain the current I1*d* from the voltage VF by using the proportional constant Mv. Therefore, the processor 121 can execute the primary correction and the secondary correction in the same manner as those of the first embodiment.

The processor 121 proceeds to Act11 after the processing of Act31.

The image forming apparatus 100 according to the second embodiment achieves the same effects as those of the image forming apparatus 100 according to the first embodiment.

Further, the image forming apparatus 100 according to the second embodiment calculates the current I1*d* by using the forward voltage VF of the laser diode LD. In the first embodiment, a voltage drop occurs by the resistance RD1 and the resistance RD2 connected in series to the laser diode LD. For example, in the first embodiment, a power supply voltage Vcc of the drive circuit 127 is set to 5[V], a forward voltage of the laser diode LD is set to 3[V], and an operation voltage of the circuit is set to 0.8[V]. In this case, a voltage at both ends of the resistance RD1 is set to 1.2[V] or lower according to 5−3−0.8=1.2. Therefore, the current I1*d*1 flowing through the resistance RD1 and the laser diode LD1 has an upper limit such that the voltage at both ends of the resistance RD1 becomes 1.2[V] or lower. Further, even when the voltage at both ends of the resistance RD1 is close to 1.2[V], a relationship between the current I1*d* and the base current of the transistor Tr1 is not linear. On the other hand, since the drive circuit 127*b* of the second embodiment does not include the resistance RD1 and the resistance RD2, the voltage drop caused by the resistance RD1 and the resistance RD2 does not occur. Therefore, in the image forming apparatus 100 according to the second embodiment, a range in which the relationship between the current I1*d* and the base current of the transistor Tr1 becomes linear is larger than that of the first embodiment.

Third Embodiment

Since the image forming apparatus 100 according to a third embodiment has the same configuration as that of the image forming apparatus 100 according to the first embodiment, the description of the configuration will be omitted.

Figure 11:
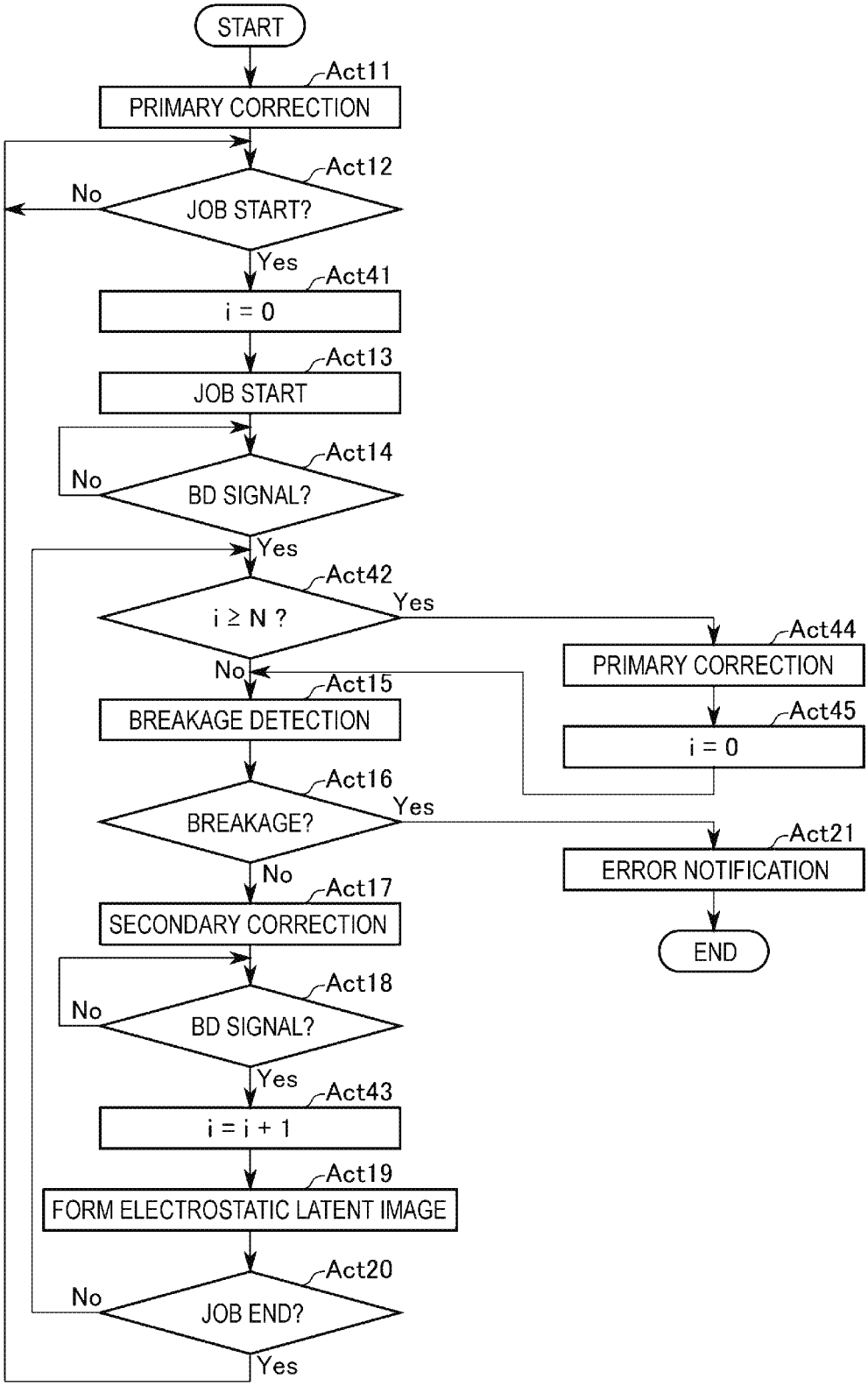
FIG. 11 is a flowchart illustrating a process according to the third embodiment.

Hereinafter, an operation of the image forming apparatus 100 according to the third embodiment will be described with reference to FIG. 11, and the like. Further, the content of the processing in the following operation description is an example, and various processing capable of obtaining the same result can be appropriately used. FIG. 11 is a flowchart illustrating a process performed by the processor 121 according to the third embodiment. The processor 121 executes the process, for example, by executing one or more programs stored in the ROM 122 or the auxiliary storage device 124, and the like.

The processor 121 performs an operation described below for each of the light sources 1061.

For example, the processor 121 starts the processing shown in FIG. 11 at power-on of the image forming apparatus 100.

In the third embodiment, when determining Yes in Act12, the processor 121 proceeds to Act41.

In Act41, the processor 121 sets a value of a variable i to 0. Further, the processor 121 allocates the variable i to the RAM 123, and the like. The processor 121 proceeds to Act13 after the processing of Act41.

In the third embodiment, when determining Yes in Act14, the processor 121 proceeds to Act42.

In Act42, the processor 121 determines whether or not the variable i is Nor greater. Further, N is any natural number. For example, N is a value determined by a developer, an administrator, or the like of the image forming apparatus 100. When the variable i is not N or greater, the processor 121 determines No in Act42 and proceeds to Act15.

In the third embodiment, when determining Yes in Act18, the processor 121 proceeds to Act43.

In Act43, the processor 121 increases the value of the variable i by 1. The processor 121 proceeds to Act19 after the processing of Act43.

When the variable i is N or greater, the processor 121 determines Yes in Act42 and proceeds to Act44. That is, the processor 121 determines Yes in Act42 whenever Act15 to Act20 are executed N times.

In Act44, the processor 121 executes the primary correction. For example, the processor 121 executes the primary correction by the same method as that of Act11. Alternatively, the processor 121 may obtain only β from equation $y=\alpha x+\beta$ indicating the characteristic curve of the slope efficiency of the laser diode LD. The processor 121 performs the subsequent processing by using α and β, or β obtained here.

The image forming apparatus 100 according to the third embodiment executes the primary correction whenever Act15 to Act20 are repeated a certain number of times, that is, whenever the electrostatic latent image is formed on a fixed line. Accordingly, the accuracy of the secondary correction increases. Therefore, the image forming apparatus 100 according to the third embodiment improves the image quality.

Further, the image forming apparatus 100 according to the third embodiment obtains β without obtaining α in the primary correction to be executed whenever Act15 to Act20 are repeated a certain number of times. In this case, the image forming apparatus 100 can execute the primary correction earlier than a case where α and β are obtained.

The first to third embodiments can also be modified as follows.

In the first to third embodiments, the image forming apparatus 100 executes the primary correction as a part of the initial operation. However, the image forming apparatus 100 may perform the primary correction at another timing such as the time of the start of the printing job, and the like. Further, the image forming apparatus 100 may perform the primary correction at the time of the start of the next printing job whenever the printing job is executed a certain number of times.

Further, the image forming apparatus 100 may perform the primary correction until the time of shipment such as the time of assembly at the factory, and the like. In this case, the image forming apparatus 100 operates, for example, in a mode for performing setting before shipment or in a mode for maintenance, and the like, thereby executing the primary correction. Further, for example, the image forming apparatus 100 operates in the mode according to an input made by an operator. The image forming apparatus 100 can reduce the time required for the execution of the initial operation or the printing job by performing the primary correction before shipment in comparison with a case where the primary correction is performed at the time of the start of the initial operation or the printing job.

In the first to third embodiments, the image forming apparatus 100 indicates the slope efficiency by an equation. However, in the image forming apparatus 100, the slope efficiency may be indicated by a table, and the like. In this case, the image forming apparatus 100 stores a combination of the output of the laser diode LD and the current flowing through the corresponding laser diode LD at a plurality of measurement points as a table.

In the first to third embodiments, the drive circuit 127 measures the output of the beam emitted from the laser diode LD by using the photodiode PD. However, the drive circuit of the embodiments may measure the output of the beam emitted from the laser diode LD by using other photodetectors other than the photodiode such as a photo register, a CCD, or the like.

In the first to third embodiments, the light source 1061 includes the laser diode LD as a beam source. However, the light source of the embodiments may include another one outputting a beam other than the laser diode instead of the laser diode.

When the light source 1061 includes n laser diodes LD, the image forming apparatus 100 may dividedly perform the secondary correction a plurality of times less than n. For example, when the light source 1061 includes 8 laser diodes LD, the image forming apparatus 100 may perform the secondary correction on 4 laser diodes LD among the 8 laser diodes, and then perform the secondary correction on the remaining 4 laser diodes.

In the above-described embodiments, the image forming apparatus 100 uses four kinds of recording materials corresponding to the four colors of CMYK. However, the image forming apparatus of the embodiments may use two, three, or five or more kinds of recording materials.

The processor 121 may realize a part or the whole of the processing to be achieved by the program in the above-described embodiments by using a hardware configuration of the circuit.

While certain embodiments have been described, these embodiments have been presented by way of example only, and are not intended to limit the scope of the inventions. Indeed, the novel apparatus and methods described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A control circuit for an image forming apparatus, comprising:

a plurality of beam sources each configured to emit a beam;

a photodetector configured to detect an intensity of the beam emitted from the plurality of beam sources; and a processor configured to measure a slope efficiency of each beam source by controlling each beam source to emit the beam with different drive currents, and acquiring the intensity of each beam detected by the photodetector, and while a job is performed by the image forming apparatus, detect a current flowing in each beam source, determine an adjustment amount of a drive current for each beam source so that the beam source emits the beam at a predetermined output, based on the detected current and the measured slope efficiency, and adjust the drive current with the determined adjustment amount.

2. The control circuit according to claim 1, wherein the current flowing in each beam source is calculated from a voltage applied to each beam source.

3. The control circuit according to claim 1, wherein the processor is further configured to measure the slope efficiency whenever the adjustment amount is determined a predetermined number of times.

4. The control circuit according to claim 1, further comprising:

a suppression circuit electrically connected between the processor and the photodetector and configured to suppress a magnitude of a voltage output by the photodetector, which corresponds to a light intensity detected by the photodetector, to a predetermined value.

5. The control circuit according to claim 4, further comprising:

an analog-to-digital converter electrically connected between the processor and the suppression circuit and configured to output to the processor a digital signal corresponding to the magnitude of the voltage suppressed by the suppression circuit.

6. The control circuit according to claim 4, wherein the predetermined value is equal to or less than a half of the upper limit of a voltage that can be input to the analog-to-digital converter.

7. The control circuit according to claim 1, wherein the processor is further configured to control all of the beam sources to emit the beam at once, and determine that at least one of the beam sources is broken when the intensity detected by the photodetector is equal to or less than a predetermined percent of an intensity that is detected if all of the beam sources emit the beam at the predetermined output.

8. The control circuit according to claim 7, wherein if the processor determines that at least one of the beam sources is broken, the processor controls a display of the image forming apparatus to output a notification that the beam source is broken.

9. An image forming apparatus comprising:

a control circuit comprising a plurality of beam sources each configured to emit a beam, a photodetector configured to detect an intensity of the beam emitted from the plurality of beam sources, and a processor configured to measure a slope efficiency of each beam source by controlling each beam source to emit the beam with different drive currents, and acquiring the intensity of each beam detected by the photodetector, and while a job is performed by the image forming apparatus, detect a current flowing in each beam source, determine an adjustment amount of a drive current for each beam source so that the beam source emits the beam at a predetermined output, based on the detected current and the measured slope efficiency, and adjust the drive current with the determined adjustment amount; and an image forming unit configured to transfer to a medium an electrostatic latent image formed by the beam emitted from each beam source in which the drive current is adjusted based on the determined adjustment amount.

10. The apparatus according to claim 9, wherein the current flowing in each beam source is calculated from a voltage applied to each beam source.

11. The apparatus according to claim 9, wherein the processor is further configured to measure the slope efficiency whenever the adjustment amount is determined a predetermined number of times.

12. The apparatus according to claim 9, wherein the control circuit further comprises a suppression circuit electrically connected between the processor and the photodetector and configured to suppress a magnitude of a voltage output by the photodetector, which corresponds to a light intensity detected by the photodetector, to a predetermined value.

13. The apparatus according to claim 12, wherein the control circuit further comprises an analog-to-digital converter electrically connected between the processor and the suppression circuit and configured to output to the processor a digital signal corresponding to the magnitude of the voltage suppressed by the suppression circuit.

14. The apparatus according to claim 12, wherein the predetermined value is equal to or less than a half of the upper limit of a voltage that can be input to the analog-to-digital converter.

15. The apparatus according to claim 9, wherein the processor is further configured to control all of the beam sources to emit the beam at once, and determine that at least one of the beam sources is broken when the intensity detected by the photodetector is equal to or less than a predetermined percent of an intensity that is detected if all of the beam sources emit the beam at the predetermined output.

16. The apparatus according to claim 15, further comprising:

a display, wherein if the processor determines that at least one of the beam sources is broken, the processor controls the display to output a notification that the beam source is broken.

17. A method performed by a control circuit for an image forming apparatus, the method comprising:

measuring a slope efficiency of each of beam sources by controlling each beam source to emit a beam with different drive currents, and acquiring an intensity of the emitted beam by a photodetector; and while a job is performed by the image forming apparatus, detecting a current flowing in each beam source, determining an adjustment amount of a drive current for each beam source so that the beam source emits the beam at a predetermined output, based on the detected current and the measured slope efficiency, and adjusting the drive current with the determined adjustment amount.

18. The method according to claim 17, wherein the current flowing in each beam source is calculated from a voltage applied to each beam source.

19. The method according to claim 17, further comprising:

measuring the slope efficiency whenever the adjustment amount is determined a predetermined number of times.

20. The method according to claim 17, further comprising:

suppressing a magnitude of a voltage output by the photodetector, which corresponds to a light intensity detected by the photodetector, to a predetermined value.

* * * * *